US010151538B2

(12) United States Patent
Lee et al.

(10) Patent No.: US 10,151,538 B2
(45) Date of Patent: Dec. 11, 2018

(54) HEAT EXCHANGER

(71) Applicant: LG ELECTRONICS INC., Seoul (KR)

(72) Inventors: Haeseung Lee, Seoul (KR); Byeongchul Na, Seoul (KR); Hyang Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/295,342

(22) Filed: Oct. 17, 2016

(65) Prior Publication Data

US 2017/0191761 A1 Jul. 6, 2017

(30) Foreign Application Priority Data

Dec. 31, 2015 (KR) ..... 10-2015-0191350

(51) Int. Cl.

| | |
|---|---|
| ***F28D 1/053*** | (2006.01) |
| ***F28F 1/12*** | (2006.01) |
| ***F28F 9/02*** | (2006.01) |
| ***F28F 9/04*** | (2006.01) |
| ***F28F 1/02*** | (2006.01) |
| *F28D 21/00* | (2006.01) |

(52) U.S. Cl.

CPC ..... *F28D 1/05375* (2013.01); *F28D 1/05391* (2013.01); *F28F 1/022* (2013.01); *F28F 1/025* (2013.01); *F28F 1/126* (2013.01); *F28F 9/0202* (2013.01); *F28F 9/028* (2013.01); *F28F 9/0282* (2013.01); *F28F 9/04* (2013.01); *F28D 2021/0068* (2013.01); *F28F 2250/108* (2013.01)

(58) Field of Classification Search

CPC ..... F28D 1/05375; F28D 1/05391; F28D 1/0246; F28D 1/0478; F28F 1/022; F28F 1/025; F28F 1/126; F28F 9/0202; F28F 9/028; F28F 9/0282; F28F 9/04

USPC ..... 165/174

See application file for complete search history.

(56) References Cited

U.S. PATENT DOCUMENTS

| | | | | |
|---|---|---|---|---|
| 5,197,539 A * | 3/1993 | Hughes | F28D 1/0246 | 165/150 |
| 5,704,415 A * | 1/1998 | Suzuki | F28D 15/0233 | 165/104.21 |
| 7,069,980 B2 * | 7/2006 | Hofbauer | F28D 1/0478 | 165/144 |

(Continued)

FOREIGN PATENT DOCUMENTS

| | | |
|---|---|---|
| CN | 1276507 | 12/2000 |
| CN | 201293571 | 8/2009 |
| KR | 10-0547320 | 6/2004 |

OTHER PUBLICATIONS

Chinese Office Action dated Aug. 15, 2018.

*Primary Examiner* — Raheena R Malik
(74) *Attorney, Agent, or Firm* — KED & Associates LLP

(57) ABSTRACT

A heat exchanger is provided that may include at least one refrigerant tube having a plurality of tube channels; a plurality of headers provided at both sides of the at least one refrigerant tube, and at least one distributor provided between one header among the plurality of header and the at least one refrigerant tube. The at least one distributor may include an opening through which the at least one refrigerant tube may be coupled to the distributor, and a shielding wall having an inlet/outlet that guides introduction or discharge of the refrigerant.

14 Claims, 12 Drawing Sheets

(56) References Cited

U.S. PATENT DOCUMENTS

| | | | | |
|---|---|---|---|---|
| 7,527,089 | B2 * | 5/2009 | Gorbounov | F25B 39/028 165/174 |
| 2005/0211420 | A1 * | 9/2005 | Takano | F25B 39/02 165/110 |
| 2006/0124289 | A1 * | 6/2006 | Shinmura | F28D 1/05391 165/176 |
| 2008/0105420 | A1 * | 5/2008 | Taras | F25B 39/00 165/174 |

* cited by examiner

HEAT EXCHANGER

CROSS-REFERENCE TO RELATED APPLICATION(S)

The present application claims priority under 35 U.S.C. 119 and 35 U.S.C. 365 to Korean Patent Application No. 10-2015-0191350, filed in Korea on Dec. 31, 2015, which is hereby incorporated by reference in its entirety.

BACKGROUND

1. Field

A heat exchanger is disclosed herein.

2. Background

In general, a heat exchanger is an apparatus used in a heat-exchanging cycle. The heat exchanger may serve as a condenser or evaporator to heat-exchange a refrigerant flowing therein with an external fluid.

The heat exchanger is generally classified into a fin-and-tube type heat exchanger and a micro-channel type heat exchanger according to its shape. The fin-and-tube type heat exchanger includes a plurality of fins and a tube having a circular shape or a shape similar thereto, which passes through the plurality of fins. The micro-channel type heat exchanger includes a plurality of flat tubes through which a refrigerant flows and a fin disposed between the plurality of flat tubes.

In both of the fin-and-tube type heat exchanger and the micro-channel type heat exchanger, a refrigerant flowing into the tube or flat tube is heat-exchanged with an external fluid, and the fin(s) functions to increase a heat exchange area between the external fluid and the refrigerant flowing in the tube or the flat tube.

A related art micro-channel type heat exchanger includes a plurality of tubes, first and second headers respectively, coupled to both sides of the plurality of tubes, and a heat dissipation fin provided between the plurality of tubes to allow heat exchange between a refrigerant and external air to be easily performed. In addition, a related art micro-channel type heat exchanger may include a baffle provided in each of the first and second headers, the baffle guiding a change in direction of a refrigerant flow path, corresponding to a volume and flow speed, caused by a phase change of a refrigerant. A plurality of the baffle may be provided inside each of the first and second headers.

The present Applicant has filed an application (hereinafter, referred to as a "prior document") related to such a micro-channel type heat exchanger, and the prior document has been registered, as Korean Registration No. KR 10-0547320, on Jan. 20, 2006 and entitled "Micro-channel Heat Exchanger", which is hereby incorporated by reference.

According to the related art heat exchanger, a refrigerant is not uniformly introduced into each tube. That is, a large amount of refrigerant is introduced into one tube among a plurality of tubes, and a relatively small amount of refrigerant is introduced into the other tubes.

More particularly, a refrigerant flow path formed in the tube is formed in only one direction toward a second header from a first header, and therefore, the refrigerant is not uniformly introduced into the plurality of tubes due to acceleration of the refrigerant.

Also, according to the related art heat exchanger, a plurality of baffles is provided in each of the first and second headers. Therefore, a large cost is incurred, and a manufacturing process is complicated. Further, according to the related art heat exchanger, refrigerant leakage occurs at a coupling portion between the header and the tube.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. However, embodiments not limited to the embodiments disclosed below, and those skilled in the art appreciating the ideas can easily propose other embodiments within the scope.

Figure 1:
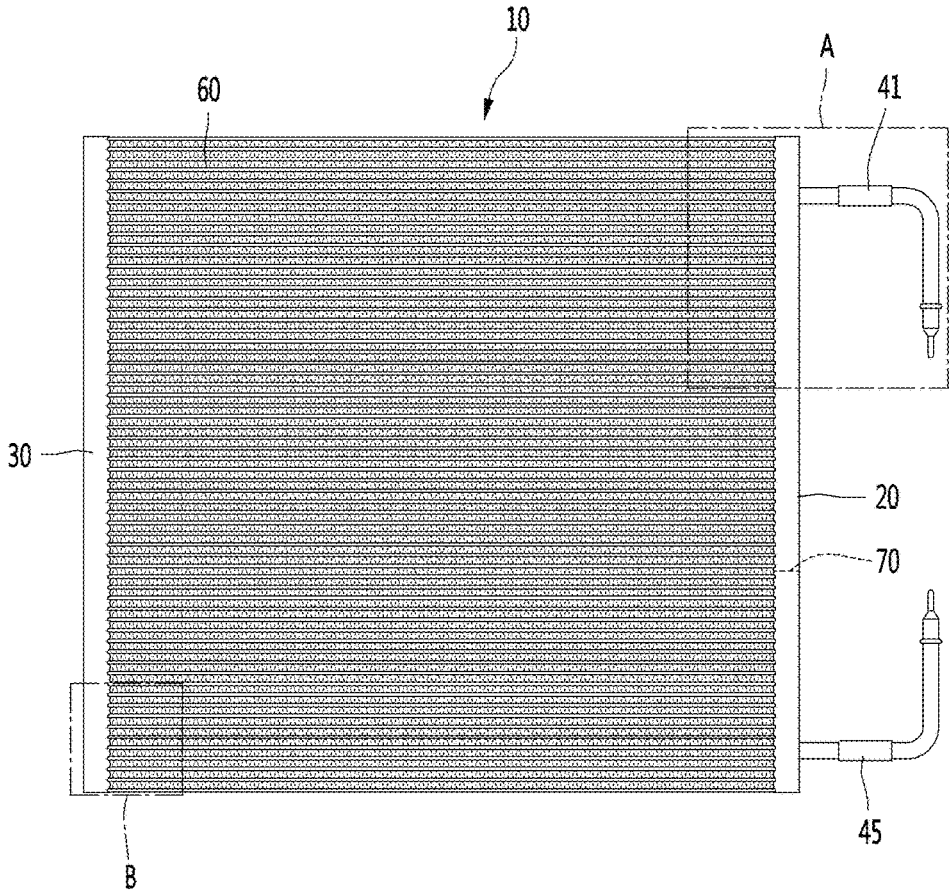
FIG. 1 is a view of a heat exchanger according to an embodiment.
Figure 2:
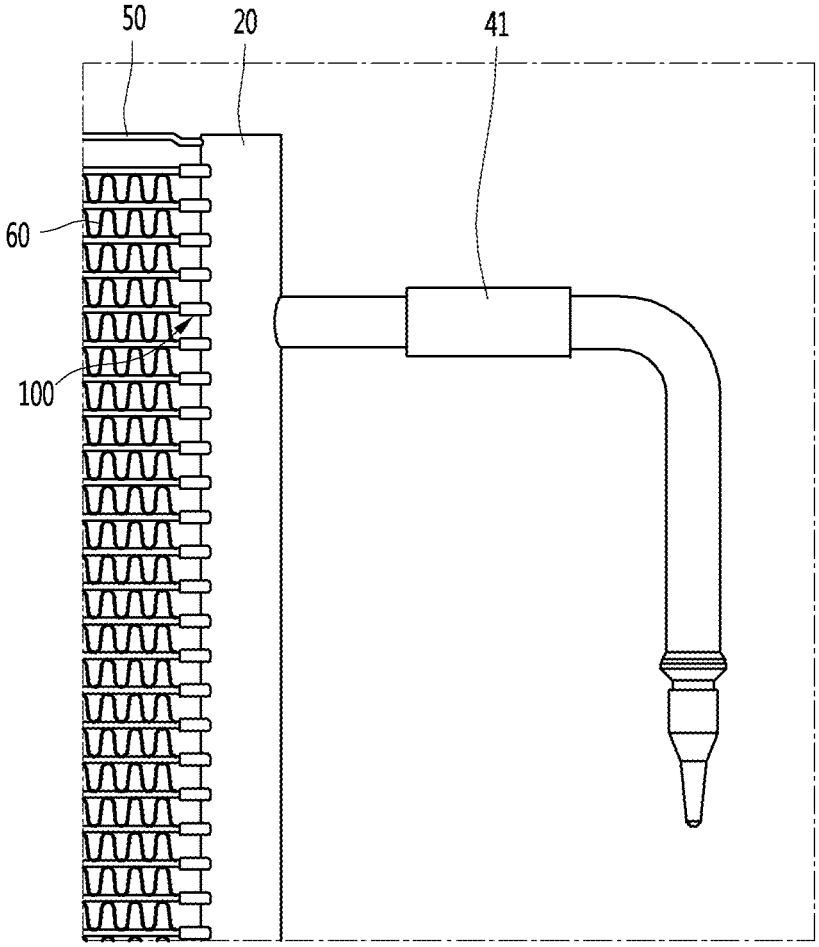
FIG. 2 is an enlarged view of portion "A" of FIG. 1.
Figure 3:
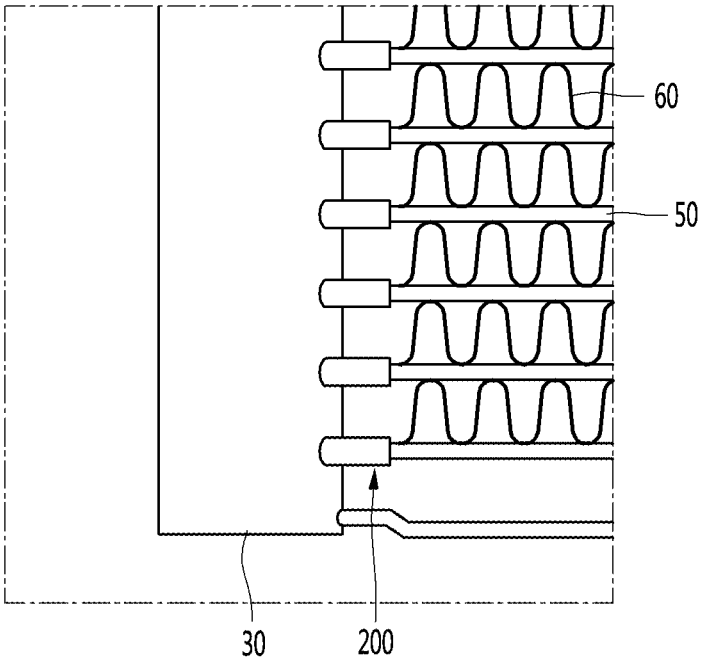
FIG. 3 is an enlarged view of portion "B" of FIG. 1.

FIG. 1 is a view of a heat exchanger according to an embodiment. FIG. 2 is an enlarged view of portion "A" of FIG. 1. FIG. 3 is an enlarged view of portion "B" of FIG. 1.

Referring to FIGS. 1 to 3, the heat exchanger 10 according to an embodiment may include headers 20 and 30 having flow spaces of a refrigerant and a plurality of refrigerant tubes 50 coupled to the headers 20 and 30. The headers 20 and 30 may include a first header 20 and a second header 30, which may be spaced apart from each other. For example, the first header 20 and the second header 30 may be arranged in a longitudinal direction. Such a header may be referred to as a "vertical header."

The plurality of refrigerant tubes 50 may include a flat tube having a flat section. The plurality of refrigerant tubes 50 may extend in a lateral direction toward the second header 30 from the first header 20. In addition, the plurality of refrigerant tubes 50 may be vertically spaced apart from each other.

The heat exchanger 10 may include fins 60 provided between the plurality of vertically arranged refrigerant tubes 50 to increase a heat exchange area between the plurality of refrigerant tubes 50 and air. The fins 60 may be configured to have a bent or curved shape between two adjacent refrigerant tubes 50.

The first header 20 may include an inlet 41, through which a refrigerant may be introduced into the heat exchanger 10, and an outlet 45, through which a refrigerant having passed through the heat exchanger 10 may be discharged to the outside. For example, the inlet 41 may be located at an upper portion of the first header 20, and the outlet 45 may be located at a lower portion of the first header 20.

For example, the heat exchanger 10 may serve as a condenser. A gaseous refrigerant introduced into the heat exchanger 10 through the inlet 41 may be phase-changed into a liquid refrigerant in a process in which the gaseous refrigerant is heat-exchanged in the heat exchanger 10. The liquid refrigerant may be discharged to the outside of the heat exchanger 10 through the outlet 45.

As another example, the heat exchanger 10 may serve as an evaporator. In this case, the inlet 41 shown in FIG. 1 may serve as an outlet of a refrigerant, and the outlet 45 shown in FIG. 1 may serve as an inlet of a refrigerant.

The first header 20 may include a baffle 70 that partitions an internal space of the first header 20. A refrigerant introduced into the first header 20 through the inlet 41 may flow into the second header 30 through the refrigerant tube 50 in an upper space of the first header 20, which may be located at an upper side of the baffle 70.

The refrigerant introduced into the second header 30 may include a refrigerant phase-changed into a liquid refrigerant in a heat exchange process. The liquid refrigerant may downwardly flow due to its weight. The liquid refrigerant gathered at a lower portion of the second header 30 may flow into a lower space of the first header 20 through the refrigerant tube 50. The lower space of the first header 20 may be a space located at a lower side of the baffle 70.

The heat exchanger 10 may include distributors 100 and 200 that connect the plurality of refrigerant tubes 50 to the headers 20 and 30. The distributors 100 and 200 may include a first distributor 100 that connects the plurality of refrigerant tubes 50 to the first header 20 and a second distributor 200 that connects the plurality of refrigerant tubes 50 to the second header 30.

A plurality of the first distributor 100 may be provided, corresponding to a number of the plurality of refrigerant tubes 50. For example, when N refrigerant tubes 50 are provided, N first distributors 100 may be provided. N is a value of 2 or more. The plurality of first distributors 100 may be coupled to one or first ends of the plurality of refrigerant tubes 50.

A plurality of the second distributor 200 may be provided, corresponding to a number of the plurality of refrigerant tubes 50. For example, when N refrigerant tubes 50 are provided, N second distributors 200 may be provided. N is a value of 2 or more. The plurality of second distributors 200 may be coupled to the other or second ends of the plurality of refrigerant tubes 50.

The first distributor 100 and the second distributor 200 may have a same configuration. Hereinafter, the configuration of the first and second distributors 100 and 200 will be described with reference to the accompanying drawings.

Figure 4:
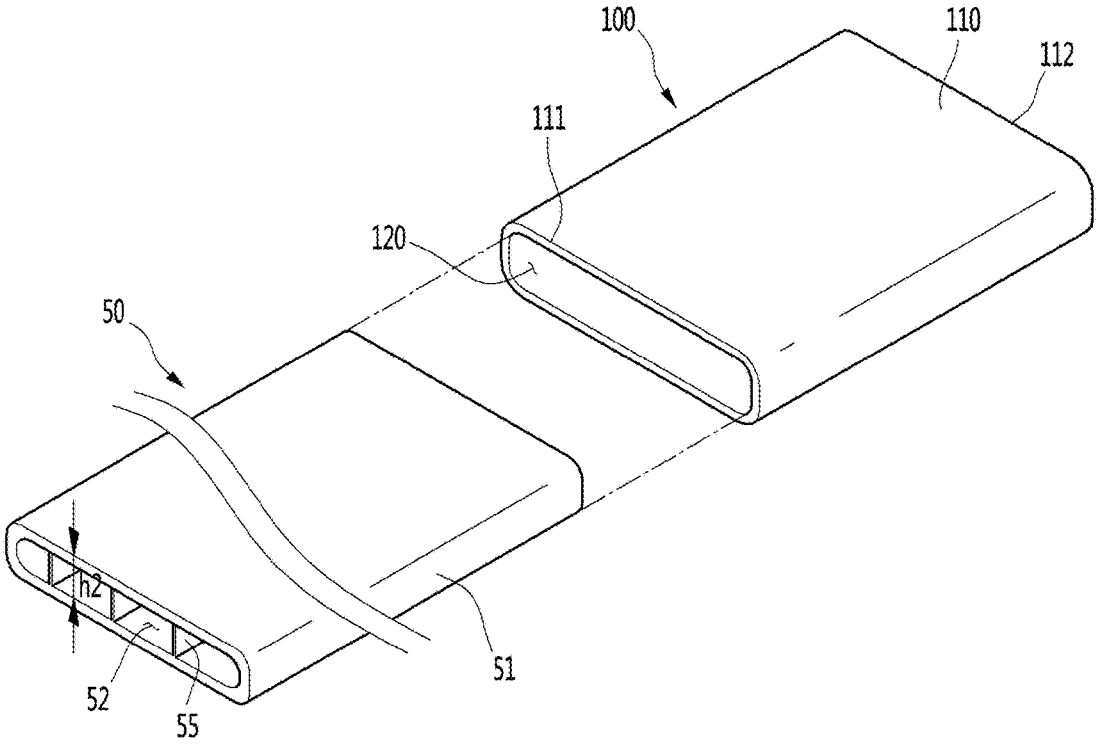
FIG. 4 is an exploded perspective view of a refrigerant tube and a distributor according to an embodiment.
Figure 5:
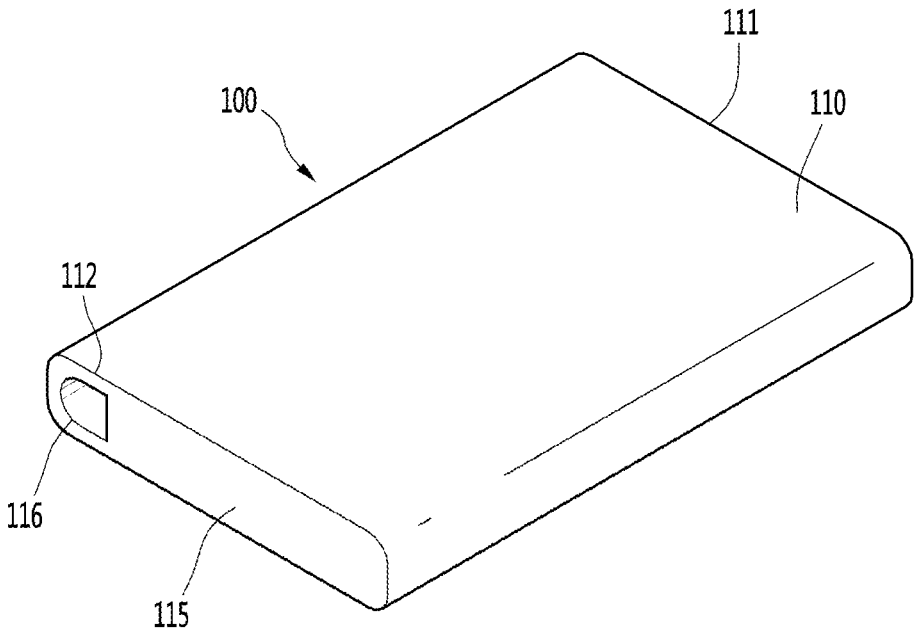
FIGS. 5 and 6 are views of a distributor according to an embodiment.
Figure 6:
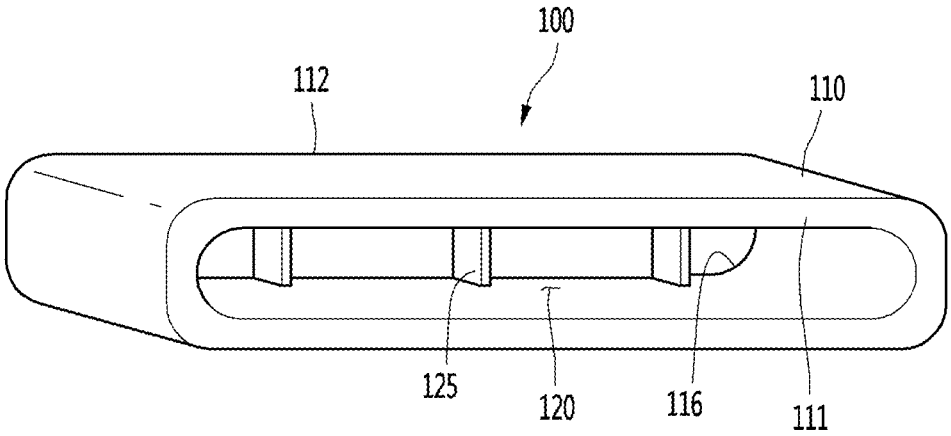
Figure 7:
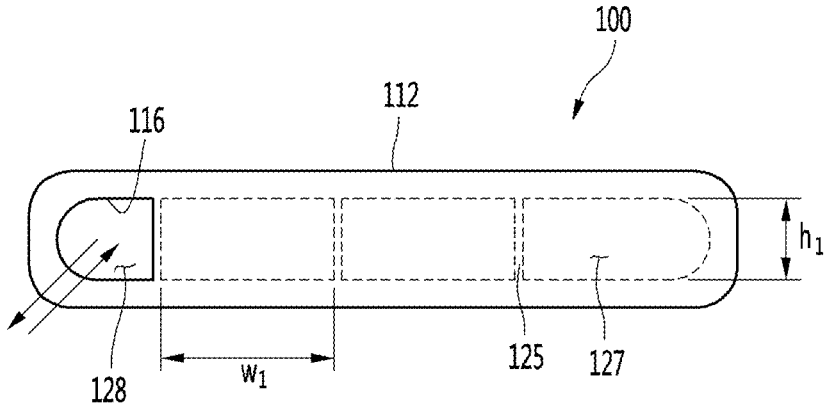
FIG. 7 is a view of a distribution channel of the distributor according to an embodiment.

FIG. 4 is an exploded perspective view of a refrigerant tube and a distributor according to an embodiment. FIGS. 5 and 6 are views of a distributor according to an embodiment. FIG. 7 is a view of a distribution channel of the distributor according to an embodiment.

Referring to FIGS. 4 to 7, the heat exchanger 10 according to an embodiment may include the first distributor 100 coupled to one or a first side of the refrigerant tube 50. As the second distributor 200 may have a same configuration as the first distributor 100, description of the second distributor 200 will be substituted with that of the first distributor 100.

The refrigerant tube 50 may include a main body 51, and a partition 55 that partitions an internal space of the refrigerant tube 50 into a plurality of tube channels 52. The partition 55 may extend from one point to an opposite point an inner circumferential surface of the refrigerant tube 50. A refrigerant introduced into the refrigerant tube 50 may be distributed and flow into the plurality of tube channels 52.

A plurality of the partition 55 may be provided. For example, as shown in FIG. 4, three partitions 55 may be provided. However, a number of the partitions 55 is not limited thereto.

The first distributor 100 may include a distributor main body 110 having a distribution space 120 therein. The distributor main body 110 may have a flat shape corresponding to a shape of the refrigerant tube 50. In addition, the refrigerant tube 50 may be inserted into the distribution space 120.

The distributor main body 110 may include one or a first side part coupled to the refrigerant tube 50 and the opposite or a second side that guides the introduction/discharge of a refrigerant. The distributor main body 110 may include a first end 111 having an opening through which the refrigerant tube 50 may be coupled to the first distributor 100, and a second end 112 forming an end opposite to the first end 111, the second end 112 having an inlet/outlet 116 through which a refrigerant may be introduced or discharged.

The first end 111 may have an open shape such that the refrigerant tube 50 may be inserted into the open shape. The second end 112 may include a shielding wall 115 that blocks introduction or discharge of the refrigerant except from the inlet/outlet 116. In other words, the shielding wall 115 may shield at least a portion of the second end 112, and the inlet/outlet 116 may be formed in the shielding wall 115.

The first distributor 100 may further include a distribution rib 125 that extends, by a set or predetermined length, toward the distribution space 120 from the shielding wall 115. The distribution rib 125 may form a guide channel 127 that changes a direction of flow of a refrigerant discharged from the refrigerant tube 50 to an opposite direction.

The distribution space 120 may include a first space, into which the refrigerant tube 50 may be inserted, and a second space, in which the guide channel 127 may be formed. The second space may be partitioned into a plurality of guide channels 127 by the distribution rib 125. A plurality of the distribution rib 125 may be provided.

For example, as shown in FIGS. 6 and 7, three distribution ribs 125 may be provided, and the second space may be partitioned into three guide channels 127 and one inlet/outlet channel 128 by the three distribution ribs 125. The one inlet/outlet channel 128 may be connected to the inlet/outlet part 116.

The guide channel 127 may have a set or predetermined width $w_1$ and a set height $h_1$. The predetermined width $w_1$ and height $h_1$ may be determined based on the width $w_2$ (see FIG. 8) and height $h_2$ (see FIG. 4) of the tube channel 52. The predetermined width $w_1$ may be determined as a value corresponding to two times the width $w_2$ of the tube channel 52, and the predetermined height $h_1$ may be determined as a value corresponding to the height $h_2$ of the tube channel 52.

For example, the predetermined width $w_1$ may be formed in a range of about 0.5 mm to about 7 mm. In addition, the predetermined height $h_1$ may be formed in a range of about 0.5 mm to about 4 mm.

Figure 8:
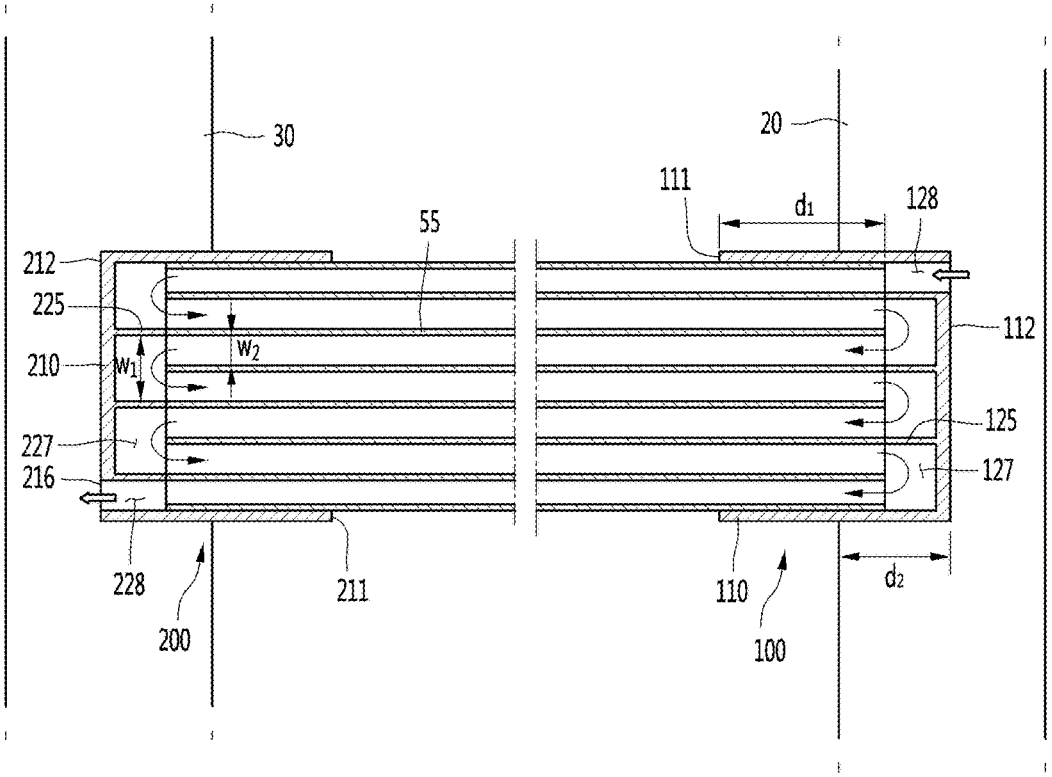
FIG. 8 is a cross-sectional view showing a state in which first and second distributors are coupled to a refrigerant tube according to an embodiment.
Figure 9:
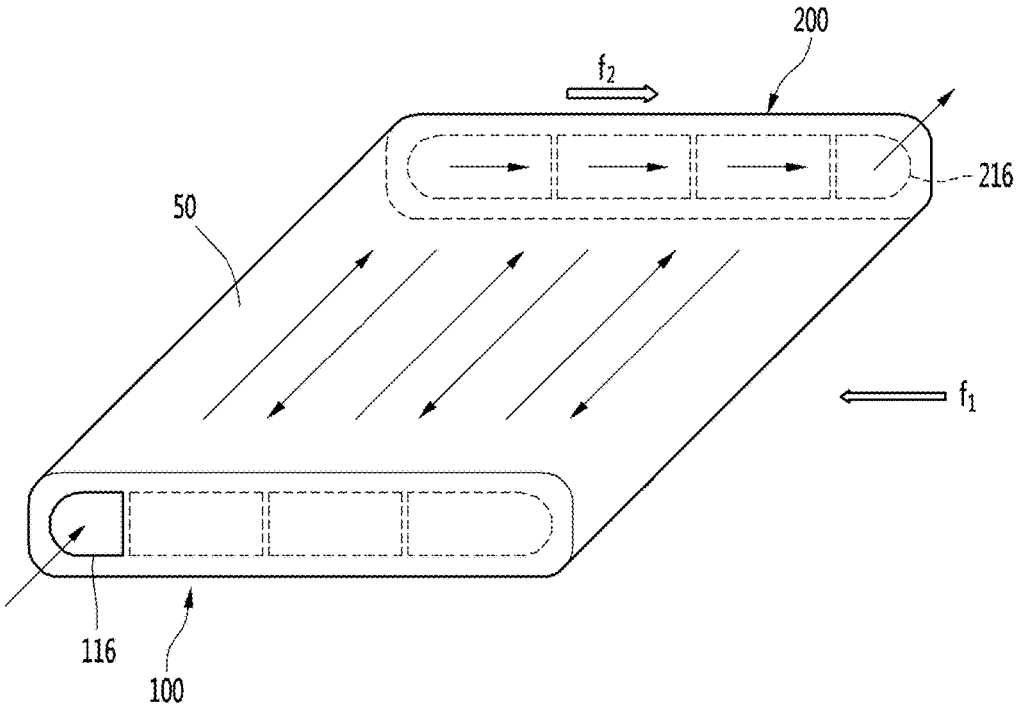
FIG. 9 is a view showing a state in which counter currents are formed between a flow of a refrigerant and a flow of air.

FIG. 8 is a cross-sectional view showing a state in which first and second distributors are coupled to a refrigerant tube according to an embodiment. FIG. 9 is a view showing a state in which counter currents are formed between a flow of a refrigerant and a flow of air.

Referring to FIGS. 8 and 9, the first distributor 100 according to an embodiment may be installed or provided between the first header 20 and the refrigerant tube 50. The first header 20 may be coupled to one or a first side of the first distributor 100, and the refrigerant tube 50 may be coupled to the opposite or a second side of the first distributor 100.

The refrigerant tube 50 may be inserted into one or a first side portion of the first distributor 100, that is, a side end portion at which the first end 111 is formed. A length, that is, an insertion depth of the refrigerant tube 50 inserted into the one side portion of the first distributor 100 may be referred to as a "first insertion depth $d_1$". For example, the first insertion depth $d_1$ may be in a range of about 2 mm to about 30 mm.

The opposite side portion of the first distributor 100, that is, a side end portion at which the second end 112 is formed, may be inserted into the internal space of the first header 20. A length, that is, an insertion depth of the first distributor 100 inserted into the first header 20 may be referred to as a "second insertion depth $d_2$". For example, the second insertion depth $d_2$ may be in a range of about 2 mm to about 20 mm.

The first distributor 100 may include the inlet/outlet part 116 through which a refrigerant in the first header 20 may be introduced into the first distributor 100, and the inlet/outlet channel 128 that extends to an inside of the first distributor 100 from the inlet/outlet 116.

The inlet/outlet 116 may be formed at the second end 112. The inlet/outlet 116 may be referred to as a "first inlet/outlet" and the inlet/outlet channel 128 may be referred to as a "first inlet/outlet channel."

The guide channel 127 defined by the distribution rib 125 may be formed in the first distributor 100. The guide channel 127 may be understood as a space between two distribution ribs 125. A plurality of the guide channel 127 may be provided.

The guide channel 127 may be connected to the tube channel 52 of the refrigerant tube 50. For example, a refrigerant flowing in the tube channel 52 of the refrigerant tube 50 may be introduced into the guide channel 127, and the direction of flow of the refrigerant may be changed to the opposite direction in a process in which the refrigerant flows in the guide channel 127.

The width $w_1$ of the guide channel 127 in the lateral direction may be greater than the width $w_2$ of the tube channel 52. For example, as described above, the width $w_1$ may have a value corresponding to two times the width $w_2$.

The second distributor 200 according to an embodiment may be installed or provided between the second header 30 and the refrigerant tube 50. The second distributor 200 may include a distributor main body 210 having one or a first side portion coupled to the second header 30 and the opposite or a second side coupled to the refrigerant tube 50.

The refrigerant tube 50 may be inserted into the first side portion of the distributor main body 210, that is, a side end portion at which a first end 211 is formed. A length, that is, an insertion depth of the refrigerant tube 50 inserted into the first side portion of the second distributor 200 may be referred to as a "first insertion depth $d_1$". For example, the first insertion depth $d_1$ may be in a range of about 2 mm to about 30 mm.

The opposite side portion of the distributor main body 210, that is, a side end portions at which a second end 212 is formed, may be inserted into an internal space of the second header 30. A length, that is, an insertion depth of the second distributor 200 inserted into the second header 30 may be referred to as "a second insertion depth $d_2$". For example, the second insertion depth $d_2$ may be formed in a range of about 2 mm to about 20 mm.

The second distributor 200 may include an inlet/outlet 216, through which a refrigerant flowing in the refrigerant tube 50 may be discharged to the outside of the second distributor 200, and an inlet/outlet channel 228 provided between the refrigerant tube 50 and the inlet/outlet 216 to allow the refrigerant flowing in the refrigerant tube 50 to be discharged to the inlet/outlet 216 therethrough.

The inlet/outlet 216 may be formed at the second end 212. The inlet/outlet 216 may be referred to as a "second inlet/outlet" and the inlet/outlet channel 228 may be referred to as a "second inlet/outlet channel."

A guide channel 227 defined by a distribution rib 225 may be formed in the second distributor 200. The guide channel 227 may be understood as a space between two distribution ribs 225. A plurality of the guide channel 227 may be provided.

The guide channel 227 may be connected to the tube channel 52 of the refrigerant tube 50. For example, a refrigerant flowing in the tube channel 52 of the refrigerant tube 50 may be introduced into the guide channel 227, and the direction of flow of the refrigerant may be changed to the opposite direction in a process in which the refrigerant flows in the guide channel 227.

The width $w_1$ of the guide channel 227 in the lateral direction may be formed greater than the width $w_2$ of the tube channel 52. For example, as described above, the width $w_1$ may have a value corresponding to two times the width $w_2$.

The flow of a refrigerant according to the embodiment will be described with reference to FIG. 8. A refrigerant introduced into the first header 20 through the inlet 41 may be introduced into the first distributor 100 through the first inlet/outlet 116. The refrigerant passing through the first inlet/outlet 116 may be introduced into a first tube channel 52 among a plurality of tube channels 52 of the refrigerant tube 50 through the first inlet/outlet channel 128.

The refrigerant may flow toward the second distributor 200 along the first tube channel 52, and be introduced into a first guide channel 227 among a plurality of guide channels 227 provided in the second distributor 200. Then, the direction of flow of the refrigerant be changed to the opposite direction in the first guide channel 227, and the refrigerant introduced into a second tube channel 52 among the plurality of tube channels 52.

The refrigerant flowing in the second tube channel 52 may flow toward the first distributor 100, and be introduced into a first guide channel 127 among a plurality of guide channels 127 provided in the first distributor 100. Then, the direction of flow of the refrigerant may be changed to the opposite direction in the first guide channel 127, and the refrigerant may be introduced into a third tube channel 52 among the plurality of tube channels 52.

The flow of the refrigerant, that is, a flow in one or a first direction sequentially toward the first distributor 100, the refrigerant tube 50, and the second distributor 200 and a flow in the other or a second direction sequentially toward the second distributor 200, the refrigerant tube 50, and the first distributor 100 may be alternately performed a plurality of times. The first direction and the second direction may form directions opposite to each other.

In addition, the flow of the refrigerant may be performed until the refrigerant is introduced into the second inlet/outlet channel 228 of the second distributor 200. If the refrigerant reaches the second inlet/outlet channel 228, the refrigerant in the second inlet/outlet channel 228 may be discharged from the second distributor 200 through the second inlet/outlet 216 of the second distributor 200.

The above-described flow of the refrigerant may be simultaneously performed in a plurality of first and second distributors 100 and 200 provided in the heat exchanger 10. In addition, the direction of flow of a refrigerant discharged from the plurality of second distributors 200, that is, a refrigerant in the second header 30 may be changed to perform flow toward the first header 20. This will be described hereinafter with reference to FIG. 10.

Counter currents of a refrigerant and air according to an embodiment will be described with reference to FIG. 9. FIG. 9 illustrates a state in which the flow of the refrigerant described in FIG. 8, that is, the flow in the first direction sequentially toward the first distributor 100, the refrigerant tube 50, and the second distributor 200 and the flow in the second direction sequentially toward the second distributor 200, the refrigerant tube 50, and the first distributor 100 are repeatedly performed.

Based on the direction in which the second distributor 200 is viewed from the first distributor 100, the first inlet/outlet 116 of the first distributor 100 is located at a left side portion of the first distributor 100 in the drawing, and the second inlet/outlet 216 of the second distributor 200 is located at a right side portion of the second distributor 200 in the drawing.

That is, in a process in which the refrigerant repeatedly flows in the first distributor 100, the refrigerant tube 50, and the second distributor 200, the refrigerant may have a direction in which the refrigerant flows in one direction (a right direction in FIG. 9) toward the second inlet/outlet 216 from the first inlet/outlet 116 (flow direction $f_2$).

The flow direction $f_2$ of the refrigerant forms a direction opposite to the flow direction $f_1$ of the air flowing in a space between the plurality of refrigerant tube 50. The flow directions of the refrigerant and the air may be defined as "counter currents." If the counter currents are formed, a heat exchange performance of the heat exchanger may be improved (see FIGS. 11A and 11B).

Figure 10:
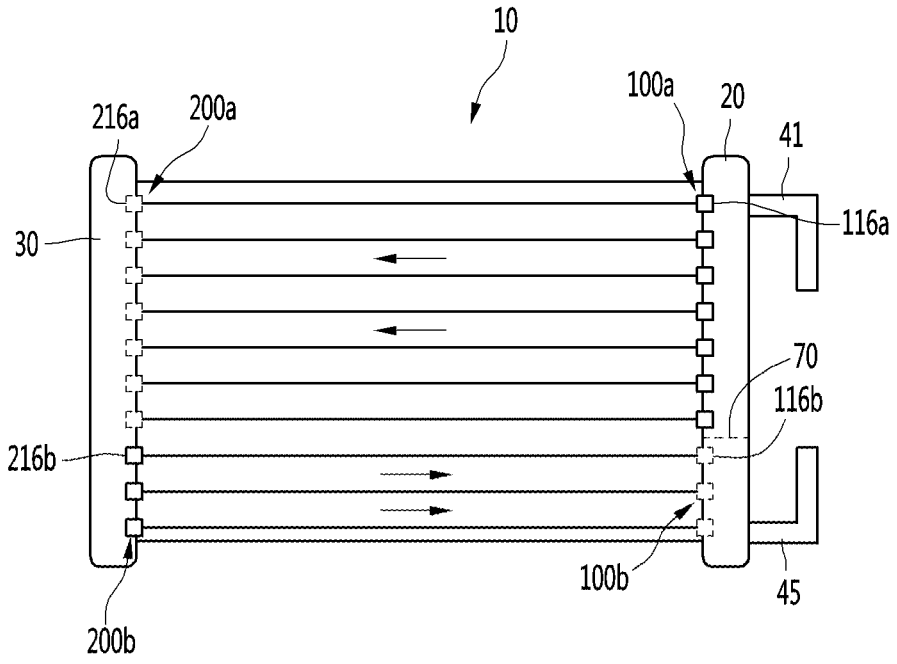
FIG. 10 is a view of a heat exchanger showing a state in which first and second distributors are coupled to refrigerant tubes according to an embodiment.

FIG. 10 is a view of a heat exchanger showing a state in which first and second distributors are coupled to refrigerant tubes according to an embodiment. Referring to FIG. 10, the heat exchanger 10 according to an embodiment may include a plurality of first distributors 100*a* and 100*b* that connects refrigerant tubes 50 to the first header 20 and a plurality of second distributors 200*a* and 200*b* that connects the refrigerant tubes 50 to the second header 30.

The plurality of first distributors 100*a* and 100*b* may include a plurality of first upper distributors 100*a* provided at positions corresponding to an upper portion of the first header 20 and a plurality of first lower distributors 100*b* provided at positions corresponding to a lower portion of the first header 20. For example, the plurality of first upper distributors 100*a* may be first distributors arranged at higher positions than the baffle 70, and the plurality of first lower distributors 100*b* may be first distributors arranged at lower positions than the baffle 70.

In addition, each of the plurality of first upper distributors 100*a* may be a first distributor having a first inlet 116*a*, through which a refrigerant may be introduced into the refrigerant tube 50 from the first header 20, and each of the plurality of first lower distributors 100*b* may be a first distributor having a second outlet 116*b*, through which a refrigerant flowing in the refrigerant tube 50 may be discharged to the first header 20. That is, an inlet/outlet of the first upper distributor 100*a* may form the first inlet 116*a*, and an inlet/outlet of the first lower distributor 100*b* may form the second outlet 116*b*.

In addition, a direction in which the first upper distributor 100*a* is coupled to the first header 20 and a direction in which the first lower distributor 100*b* is coupled to the first header 20 may be opposite to each other. That is, based on the flow direction $f_2$ (see FIG. 9) of air approaching the heat exchanger 10, the first inlet 116*a* may be formed at a relatively distant position, and the second outlet 116*b* may be formed at a relatively close position. According to the above-described configuration, counter currents of the refrigerant and the air may be easily made.

The plurality of second distributors 200*a* and 200*b* may include a plurality of second upper distributors 200*a* provided at positions corresponding to an upper portion of the second header 30 and a plurality of second lower distributors 200*b* provided at positions corresponding to a lower portion of the second header 30. For example, the plurality of second upper distributors 200*a* may be second distributors arranged at higher positions than the baffle 70, that is, positions respectively corresponding to the plurality of first upper distributors 100*a*, and the plurality of second lower distributors 200*b* may be second distributors arranged at lower positions than the baffle 70, that is, positions respectively corresponding to the plurality of first lower distributors 100*b*.

In addition, each of the plurality of second upper distributors 200*a* may be a second distributor having a first outlet 216*a*, through which a refrigerant may be discharged from the refrigerant tube 50 to the second header 30, and each of the plurality of second lower distributors 200*b* may be a second distributor having a second inlet 216*b*, through which a refrigerant in the second header 30 may be introduced into the refrigerant tube 50. That is, an inlet/outlet of the second upper distributor 200*a* may form the first outlet 216*a*, and an inlet/outlet of the second lower distributor 200*b* may form the second inlet 216*b*.

In addition, a direction in which the second upper distributor 200*a* is coupled to the second header 30 and a direction in which the second lower distributor 200*b* is coupled to the second header 30 may be opposite to each other. That is, based on the flow direction $f_2$ (see FIG. 9) of air approaching the heat exchanger 10, the first outlet 216*a* may be formed at a relatively close position, and the second inlet 216*b* may be formed at a relatively distant position. According to the above-described configuration, counter currents of the refrigerant and the air may be easily made.

In FIG. 9, when the coupling direction of the distributor is described, a case in which the inlet/outlet is formed at a relatively distant position with respect to the flow direction $f_2$ of the air is indicated by a solid line, and a case in which the inlet/outlet is formed at a relatively close position with respect to the flow direction $f_2$ of the air is indicated by a dotted line.

A refrigerant introduced into the refrigerant tube 50 through the first inlets 116*a* of the plurality of the first upper distributors 100*a* and discharged to the second header 200 through the first outlets 216*a* of the plurality of second upper distributors 200*a* may be introduced into the second inlets 216*b* of the plurality of second lower distributors 200*b*. Then, the refrigerant introduced into the second inlets 216*b* may be discharged to the first header 20 through the second outlet 116*b* of the plurality of first lower distributors 100*b* via the refrigerant tub 50. Then, the refrigerant in a lower space of the first header 20 may be discharged from the heat exchanger 10 through the outlet 45.

A refrigerant may flow while the direction of the refrigerant is changed through the plurality of guide channels 127 formed in the first distributor 100, the tube channels 52 of the refrigerant tube 50, and the plurality of guide channels 227 formed in the second distributor 200, so that a length of a refrigerant flow path may be increased. Thus, many baffles 70 for increasing the length of the refrigerant flow path are not required in the first header 20 or the second header 30.

Figure 11A:
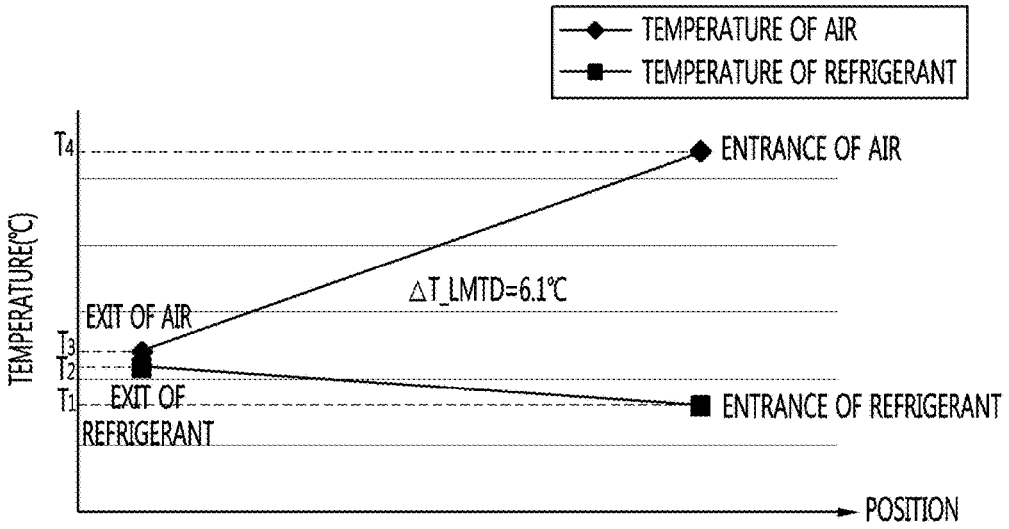
FIGS. 11A and 11B are experimental graphs showing that heat exchange performance is improved as counter currents are formed between a flow of a refrigerant and a flow of air.
Figure 11B:
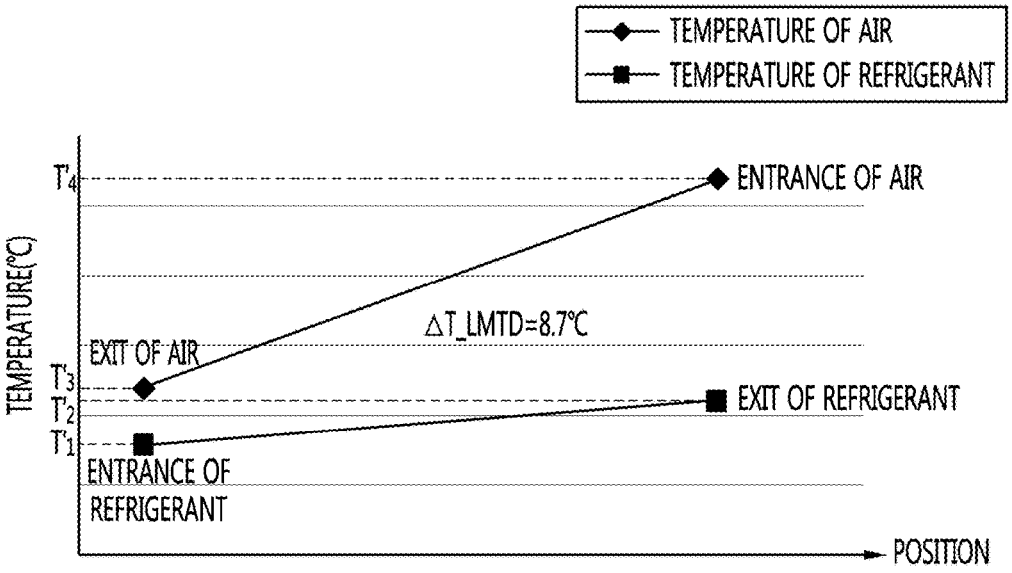

FIGS. 11A and 11B are experimental graphs showing that heat exchange performance is improved as counter currents are formed between a flow of a refrigerant and a flow of air.

FIG. 11A shows a change in temperature of an entrance/exit of air and a change in temperature of an entrance/exit of refrigerant when a flow direction of the air and a flow direction of the refrigerant are parallel to each other, that is, when parallel currents formed in the same direction are formed. On the other hand, FIG. 11B shows a change in temperature of an entrance/exit of air and a change in temperature of an entrance/exit of refrigerant in a case of counter currents in which the flow direction of the air and the flow direction of the refrigerant are formed opposite to each other.

Referring to FIG. 11A, it can be seen that, based on a position of a horizontal axis, a position of an entrance, at which the air reaches the heat exchanger 10, and a position of an exit, at which the refrigerant is introduced into the refrigerant tube of the heat exchanger 10 are formed at an approximately same position, and a position of an exit, at which the air is discharged out of the heat exchanger 10, and a position of an exit, at which the refrigerant is discharged from the refrigerant tube of the heat exchanger 10 are formed at an approximately same position. In addition, it is assumed that temperatures at the entrance and exit of the refrigerant are $T_1$ and $T_2$, respectively, and temperatures at the entrance and exit of the air are $T_4$ and $T_3$, respectively.

Referring to FIG. 11B, it can be seen that, based on a position of a horizontal axis, a position of an entrance, at which the air reaches the heat exchanger 10, and a position of an exit, at which the refrigerant is discharged from the refrigerant tube of the heat exchanger 10 are formed at an approximately same position, and a position of an exit, at which the air is discharged out of the heat exchanger 10, and a position of an exit, at which the refrigerant is introduced into the refrigerant tube of the heat exchanger 10 are formed at an approximately same position. In addition, it is assumed that temperatures at the entrance and exit of the refrigerant are $T'_1$ and $T'_2$, respectively, and temperatures at the entrance and exit of the air are $T'_4$ and $T'_3$, respectively.

A heat exchange performance or heat exchange amount (Q) of the heat exchanger may be determined by the following equation.

$$Q=U*A*\Delta T_LMTD$$

Where, U is a heat transfer coefficient (W/m$^{2}$° C.), A is a heat exchange area (m$^2$), and ΔT_LMTD is a logarithmic mean temperature difference (° C.).

When U and A are constant, the heat exchange amount (Q) may be changed depending on a logarithmic mean temperature difference. The logarithmic mean temperature difference may be determined according to temperature difference values at positions (the entrance and exit of the air) at which heat exchange is made, that is, a value of $(T_3-T_2)$ and a value of $(T_4-T_1)$ in FIG. 11A, or a value of $(T'_3-T'_2)$ and a value of $(T'_4-T'_1)$ in FIG. 11B.

As the temperature difference value at the entrance of the air is decreased and the temperature difference value at the exit of the air is increased, the logarithmic mean temperature difference may be increased. For example, when the values of $T_1$ to $T_4$ are 8° C., 11° C., 12° C., and 27° C., respectively, the logarithmic mean temperature difference may be 6.1° C. When the values of $T'_1$ to $T'_4$ are 8° C., 11° C., 12° C., and 27° C., respectively, the logarithmic mean temperature difference may be 8.7° C.

Referring to FIGS. 11A and 11B, for the logarithmic mean temperature difference, the value in FIG. 11B may be greater than that in FIG. 11A. Accordingly, it can be seen that the heat exchange amount (Q) under conditions of FIG. 11B is greater than that under conditions of FIG. 11A.

As described above, as the first and second distributors 100 and 200 are provided, counter currents between a flow of the air and a flow of the refrigerant are formed, so that it is possible to improve the heat exchange amount and heat exchange performance of the heat exchanger 10.

According to embodiments disclosed herein, distributors are provided, so that a refrigerant may be uniformly introduced into a plurality of refrigerant tubes. Also, distribution channels partitioned by a distribution rib are formed at positions respectively corresponding to tube channels in the refrigerant tube to change a direction of flow of a refrigerant, so that a length of a refrigerant flow path may be increased.

Further, in a process in which a refrigerant is introduced into an inlet/outlet of a first distributor to flow into a refrigerant tube, and then discharged through an inlet/outlet of a second distributor, a direction of flow of the refrigerant may be formed opposite to a direction of flow of air. That is, counter currents of the air and the refrigerant may be formed. Thus, as the counter currents are formed, it is possible to improve a heat exchange performance of the heat exchanger.

Furthermore, as a length of a refrigerant flow path is increased in the refrigerant tube, a large number of paths through which a refrigerant flows from one to the other of two headers are not required. Thus, it is possible to decrease a number of baffles in the header. Accordingly, it is possible to reduce manufacturing costs of the heat exchanger and to simplify a manufacturing process of the heat exchanger.

Additionally, a thickness of the distributor may be configured to be thicker than a thickness of the refrigerant tube, and the distributor may firmly couple the refrigerant tube and the header, thereby preventing leakage of a refrigerant.

Embodiments disclosed herein provide a heat exchanger in which a refrigerant may be uniformly introduced into a plurality of tubes. Embodiments disclosed herein also provide a heat exchanger capable of improving heat exchange efficiency by preventing refrigerant imbalance.

Embodiments disclosed herein provide a heat exchanger that may include a refrigerant tube having a plurality of tube channels; a plurality of headers provided at both sides of the refrigerant tube; and a distributor provided between one header among the plurality of headers and the refrigerant tube. The distributor may include an opening through which the refrigerant tube may be coupled to the distributor, and a shielding wall having an inlet/outlet part or inlet/outlet that guides introduction or discharge of the refrigerant.

The distributor may include a plurality of guide channels formed in a distribution space part or space of a distribution main body, the plurality of guide channels changing a direction of flow of the refrigerant flowing in the tube channel. The distributor may further include a distribution rib that extends from the shielding wall, the distribution rib partitioning the distribution space part into the plurality of guide channels. A width $w_1$ of the guide channel in the one or a first direction may be formed to have a value corresponding to two times a width $w_2$ of the tube channel in the one direction.

The distributor may include a first distributor coupled to a first header among the plurality of headers, and a second distributor coupled to a second header among the plurality of headers. The inlet/outlet part may include an inlet part or inlet formed in the first distributor, the inlet part through which the refrigerant in the first header may be introduced into the refrigerant tube, and an outlet part or outlet formed in the second distributor, the outlet part through which the refrigerant in the refrigerant tube may be discharged to the second header.

The plurality of guide channels may include a first guide channel that changes a direction of flow of the refrigerant discharged from one tube channel among the plurality of tube channels to an opposite direction, and a second guide channel that changes the direction of flow of the refrigerant discharged from another tube channel among the plurality of tube channels to the opposite direction.

The first distributor may be provided in plurality. The plurality of first distributors may include a first upper distributor connected to an upper portion of the first header, the first upper distributor having a first inlet part or inlet through which the refrigerant may be introduced from the first header, and a first lower distributor connected to a lower portion of the first header, the first lower distributor having a second outlet part or outlet through which the refrigerant may be discharged from the refrigerant tube. Each of the first inlet part and the second outlet part may constitute the inlet/outlet part.

The second distributor may be provided in plurality. The plurality of second distributors may include a second upper distributor connected to an upper portion of the second header, the second upper distributor having a first outlet part or outlet through which the refrigerant may be discharged from the refrigerant tube, and a second lower distributor connected to a lower portion of the second header, the second lower distributor having a second inlet part or inlet through which the refrigerant may be introduced from the second header. Each of the first outlet part and the second inlet part may constitute the inlet/outlet part.

Embodiments disclosed herein further provide a heat exchanger that may include first and second distributors. The first distributor or the second distributor may include a distributor main body having a distribution space part or space; a plurality of distribution ribs installed or provided inside of the distributor main body; guide channels partitioned by the plurality of distribution ribs, the guide channels changing a direction of flow of the refrigerant discharged from the refrigerant tube; and an inlet/outlet part or inlet/outlet formed in the distribution main body, the inlet/outlet part guiding introduction/discharge of the refrigerant in the first distributor or the second distributor such that the direction of flow of the refrigerant is formed opposite to the direction of flow of air.

The distributor main body may include a first end part or end having an opening through which the refrigerant tube may be coupled to the first distributor or the second distributor, and a second end part or end forming an opposite end part of the first end part. The second end part may have the inlet/outlet part and a shielding wall that shields introduction or discharge of the refrigerant.

The distribution rib may extend, by a set or predetermined length, toward the distribution space part from the shielding wall. The distribution space part may include a first space into which the refrigerant tube may be inserted and a second space in which the guide channel may be formed. The second space may be partitioned into a plurality of guide channels by the distribution rib.

The refrigerant tube may include a partition part or partition that extends from one point to the opposite point of an inner circumferential surface of the refrigerant tube to partition an internal space of the refrigerant tube into a plurality of tube channels.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope as defined by the appended claims. Therefore, the preferred embodiments should be considered in descriptive sense only and not for purposes of limitation, and also the technical scope is not limited to the embodiments. Furthermore, is defined not by the detailed description but by the appended claims, and all differences within the scope will be construed as being comprised in the present disclosure.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger, comprising:

at least one refrigerant tube configured for a refrigerant to flow therein, the at least one refrigerant tube having a plurality of tube channels;

a first header and a second header provided at both sides of the at least one refrigerant tube, respectively; and a distributor provided between the first header or the second header and the at least one refrigerant tube, wherein the distributor includes a first distributor coupled to the first header and a second distributor coupled to the second header so as to be opposite to a coupling direction of the first distributor, wherein the first distributor includes:

a first upper distributor coupled to an upper portion of the first header, the first upper distributor having a first inlet through which the refrigerant is introduced from the first header; and a first lower distributor coupled to a lower portion of the first header so as to be opposite to a coupling direction of the first upper distributor, the first lower distributor having a second outlet through which the refrigerant is discharged from the refrigerant tube, and wherein the second distributor includes:

a second upper distributor coupled to an upper portion of the second header, the second upper distributor having a first outlet through which the refrigerant is discharged from the refrigerant tube; and a second lower distributor coupled to a lower portion of the second header so as to be opposite to a coupling direction of the second upper distributor, the second lower distributor having a second inlet through which the refrigerant is introduced from the second header.

2. The heat exchanger according to claim 1, wherein each of the first distributor and the second distributor includes:

an opening forming at a first side of the distributor and through which the refrigerant tube is coupled to the distributor;

a shielding wall having an inlet/outlet on a second side of the distributor wherein the inlet/outlet is configured to guide introduction or discharge of the refrigerant;

a distributor main body having a distribution space; and a plurality of guide channels formed in the distribution space, the plurality of guide channels being configured to change a direction of flow of the refrigerant flowing in the plurality of tube channels.

3. The heat exchanger according to claim 1, wherein the first inlet is formed at a relatively distant position than the first outlet based on a flow direction of air approaching the heat exchanger.

4. The heat exchanger according to claim 2, wherein each of the first distributor and the second distributor further includes at least one distribution rib that extends from the shielding wall, and wherein the at least one distribution rib partitions the distribution space into the plurality of guide channels.

5. The heat exchanger according to claim 2, wherein a width of the guide channel in a first direction is formed greater than a width of the tube channel in the first direction.

6. The heat exchanger according to claim 5, wherein the width of the guide channel in the first direction is formed to have a value corresponding to two times the width of the tube channel in the first direction.

7. The heat exchanger according to claim 2, wherein the plurality of guide channels includes:

a first guide channel that changes a direction of flow of the refrigerant discharged from one tube channel among the plurality of tube channels to an opposite direction; and a second guide channel that changes a direction of flow of the refrigerant discharged from another tube channel among the plurality of tube channels to an opposite direction.

8. The heat exchanger according to claim 1, wherein the refrigerant tube is arranged to extend in a lateral direction, and the plurality of headers is arranged to extend in a longitudinal direction.

9. The heat exchanger according to claim 8, wherein the at least one refrigerant tube includes a plurality of refrigerant tubes spaced apart from each other in the longitudinal direction, and wherein the heat exchanger further includes a plurality of fins provided between the plurality of refrigerant tubes.

10. A heat exchanger, comprising:

a plurality of refrigerant tubes configured for a refrigerant to flow therein, the plurality of refrigerant tubes each having a plurality of tube channels;

first and second headers provided at both sides of the plurality of refrigerant tubes, respectively; and a plurality of first and second distributors provided between the first and second headers, respectively, and the plurality of refrigerant tubes, wherein a direction in which the second distributor is coupled to the second header and a direction in which the first distributor is coupled to the first header are opposite to each other, and wherein the plurality of first and second distributors includes:

an upper distributor coupled to an upper portion of the first and second headers; and a lower distributor coupled to a lower portion of the first and second headers, wherein a direction in which the upper distributor is coupled to the first and second headers and a direction in which the lower distributor is coupled to the first and second headers are formed opposite to each other.

11. The heat exchanger according to claim 10, wherein each distributor includes:

a distributor main body having a distribution space;

an opening forming at a first side of the distributor main body and through which the at least one refrigerant tube is coupled to the distributor;

a plurality of guide channels formed in the distribution space, the plurality of guide channels being configured to change a direction of flow of the refrigerant flowing in the plurality of tube channels;

a wall having an inlet/outlet at a second side of the distributor body; and at least one distribution rib that extends from the wall, and wherein the at least one distribution rib partitions the distribution space into the plurality of guide channels.

12. The heat exchanger according to claim 11, wherein a width of the guide channel in a first direction is formed greater than a width of the tube channel in the first direction.

13. The heat exchanger according to claim 10, wherein the plurality of first distributors includes:

at least one first upper distributor connected to an upper portion of the first header, the at least one first upper distributor having a first inlet through which the refrigerant is introduced from the first header; and at least one first lower distributor connected to a lower portion of the first header, the at least one first lower distributor having a second outlet through which the refrigerant is discharged from the refrigerant tube.

14. The heat exchanger according to claim 13, wherein the first inlet is formed at a relatively distant position than the second outlet based on a flow direction of air approaching the heat exchanger.

* * * * *